US011195540B2

(12) United States Patent
Ebenezer et al.

(10) Patent No.: US 11,195,540 B2
(45) Date of Patent: Dec. 7, 2021

(54) METHODS AND APPARATUS FOR AN ADAPTIVE BLOCKING MATRIX

(71) Applicant: Cirrus Logic International Semiconductor Ltd., Edinburgh (GB)

(72) Inventors: Samuel Ebenezer, Tempe, AZ (US); Wilbur Lawrence, Tempe, AZ (US)

(73) Assignee: Cirrus Logic, Inc., Austin, TX (US)

( * ) Notice: Subject to any disclaimer, the term of this patent is extended or adjusted under 35 U.S.C. 154(b) by 325 days.

(21) Appl. No.: 16/258,911

(22) Filed: Jan. 28, 2019

(65) Prior Publication Data

US 2020/0243105 A1 Jul. 30, 2020

(51) Int. Cl.

| | |
|---|---|
| ***G10L 21/0264*** | (2013.01) |
| ***G10L 21/0216*** | (2013.01) |
| ***H04R 3/00*** | (2006.01) |
| ***G10L 21/0224*** | (2013.01) |
| ***G10L 25/78*** | (2013.01) |

(52) U.S. Cl.

CPC ..... *G10L 21/0264* (2013.01); *G10L 21/0216* (2013.01); *G10L 21/0224* (2013.01); *H04R 3/005* (2013.01); *G10L 25/78* (2013.01); *G10L 2021/02166* (2013.01)

(58) Field of Classification Search

CPC ..... G10L 2021/02166; G10L 25/78; G10L 21/0232; G10L 15/20; G10L 15/22; G10L 19/012; G10L 19/0208; G10L 2021/02161; G10L 2021/02165; G10L 21/0216; G10L 21/0224; G10L 21/0264; G10L 21/0324; G10L 21/0388; G10L 25/03; G10L 25/21; G10L 25/84; G10L 21/0208

See application file for complete search history.

(56) References Cited

U.S. PATENT DOCUMENTS 4,932,063 A * 6/1990 Nakamura ..... G10L 21/0208 381/94.3
8,195,246 B2 * 6/2012 Vitte ..... G10L 21/0208 455/570

(Continued)

FOREIGN PATENT DOCUMENTS

GB 2542862 A 4/2017
WO 2005050618 A2 6/2005

OTHER PUBLICATIONS

Search Report under Section 17, UKIPO, Application No. GB2001047.6, dated Jul. 20, 2020.

*Primary Examiner* — Matthew H Baker
(74) *Attorney, Agent, or Firm* — Jackson Walker L.L.P.

(57) ABSTRACT

Methods and apparatus for digital signal processing of signals received from sensors are provided. A first input signal and a second input signal are received. A noise correlation statistic between the first input signal and the second input signal is estimated. An inter sensor signal model representative of a relationship between desired signal components present in the first input signal and the second input signal is estimated. Responsive to the noise correlation statistic meeting a predefined condition, estimating the inter sensor signal model is based on the noise correlation statistic. Responsive to the noise correlation statistic not meeting the predefined condition, estimating the inter sensor signal model is based on a constrained noise correlation statistic derived from the noise correlation statistic.

35 Claims, 8 Drawing Sheets

(56) References Cited

U.S. PATENT DOCUMENTS

| | | | | |
|---|---|---|---|---|
| 8,374,358 | B2 * | 2/2013 | Buck | G10L 21/0208 381/94.1 |
| 8,781,137 | B1 * | 7/2014 | Goodwin | G10L 21/0208 381/94.1 |
| 9,319,781 | B2 * | 4/2016 | Alderson | G10K 11/17817 |
| 9,368,099 | B2 * | 6/2016 | Alderson | G10K 11/17815 |
| 9,414,150 | B2 * | 8/2016 | Hendrix | H04R 1/1083 |
| 9,607,603 | B1 * | 3/2017 | Ebenezer | H04R 1/1083 |
| 10,219,071 | B2 * | 2/2019 | Alderson | G10K 11/17854 |
| 10,554,822 | B1 * | 2/2020 | Simhi | H04N 21/233 |
| 10,580,428 | B2 * | 3/2020 | Osako | G10L 21/0208 |
| 2002/0126856 | A1 * | 9/2002 | Krasny | G10L 21/0208 381/94.1 |
| 2003/0027600 | A1 * | 2/2003 | Krasny | G10L 21/0208 455/564 |
| 2009/0121934 | A1 | 5/2009 | Sugiyama | |
| 2009/0164212 | A1 * | 6/2009 | Chan | G10L 21/0208 704/226 |
| 2014/0185826 | A1 * | 7/2014 | Tawada | G10L 21/0232 381/94.1 |
| 2015/0139444 | A1 * | 5/2015 | Frazier | G01H 5/00 381/92 |
| 2018/0122399 | A1 * | 5/2018 | Janse | G10L 21/0208 |
| 2018/0204580 | A1 * | 7/2018 | Fischer | G10L 21/0232 |

* cited by examiner

METHODS AND APPARATUS FOR AN ADAPTIVE BLOCKING MATRIX

TECHNICAL FIELD

Embodiments described herein relate to digital signal processing. More specifically, portions of this disclosure relate to digital signal processing for microphones.

BACKGROUND

Telephones and other communications devices are used all around the globe in a variety of conditions, not just quiet office environments. Voice communications can happen in diverse and harsh acoustic conditions, such as automobiles, airports, restaurants, etc. Specifically, the background acoustic noise can vary from stationary noises, such as road noise and engine noise, to non-stationary noises, such as babble and speeding vehicle noise. Mobile communication devices need to reduce these unwanted background acoustic noises in order to improve the quality of voice communication. If the origin of these unwanted background noises and the desired speech are spatially separated, then the device can extract the clean speech from a noisy microphone signal using beamforming.

One manner of processing environmental sounds to reduce background noise is to place more than one microphone on a mobile communications device. Spatial separation algorithms use these microphones to obtain the spatial information that is necessary to extract the clean speech by removing noise sources that are spatially diverse from the speech source. Such algorithms improve the signal-to-noise ratio (SNR) of the noisy signal by exploiting the spatial diversity that exists between the microphones. One such spatial separation algorithm is adaptive beamforming, which adapts to changing noise conditions based on the received data. Adaptive beamformers may achieve higher noise cancellation or interference suppression compared to fixed beamformers. One such adaptive beamformer is a Generalized Sidelobe Canceller (GSC). The fixed beamformer of a GSC forms a microphone beam towards a desired direction, such that only sounds in that direction are captured, and the blocking matrix of the GSC forms a null towards the desired look direction. One example of a GSC is shown in FIG. 1.

FIG. 1 is an example of an adaptive beamformer according to the prior art. An adaptive beamformer 100 includes microphones 102 and 104, for generating signals x1[n] and x2[n], respectively. The signals x1[n] and x2[n] are provided to a fixed beamformer 110 and to a blocking matrix 120. The fixed beamformer 110 produces a signal, a[n], which is a noise reduced version of the desired signal contained within the microphone signals x1[n] and x2[n]. The blocking matrix 120, through operation of an adaptive filter 122, generates a b[n] signal, which is a noise signal. The relationship between the desired signal components that are present in both of the microphones 102 and 104, and thus signals x1[n] and x2[n], is modeled by a linear time-varying system, and this linear model h[n] is estimated using the adaptive filter 122. The reverberation/diffraction effects and the frequency response of the microphone channel can all be subsumed in the impulse response h[n]. Thus, by estimating the parameters of the linear model, the desired signal (e.g., speech) in one of the microphones 102 and 104 and the filtered desired signal from the other microphone are closely matched in magnitude and phase thereby, greatly reducing the desired signal leakage in the signal b[n]. The signal b[n] is processed in adaptive noise canceller 130 to generate signal w[n], which is a signal containing all correlated noise in the signal a[n]. The signal w[n] is subtracted from the signal a[n] in adaptive noise canceller 130 to generate signal y[n], which is a noise reduced version of the desired signal picked up by microphones 102 and 104.

One problem with the conventional beamformer is that the adaptive blocking matrix 120 may unintentionally remove some noise from the signal b[n] causing noise in the signals b[n] and a[n] to become uncorrelated. This uncorrelated noise cannot be removed in the adaptive noise canceller 130. Thus, some of the undesired noise may remain present in the signal y[n] generated in adaptive noise canceller 130 from the signal b[n]. The noise correlation is lost in the adaptive filter 122. Thus, it would be desirable to modify processing in the adaptive filter 122 of the conventional adaptive beamformer 100 to reduce destruction of noise cancellation within the adaptive filter 122.

Shortcomings mentioned here are only representative and are included simply to highlight that a need exists for improved electrical components, particularly for signal processing employed in consumer-level devices, such as mobile phones, wearable devices and smart home devices with voice interfaces or other sensors. Embodiments described herein address certain shortcomings but not necessarily each and every one described here or known in the art.

SUMMARY

According to some embodiments, there is provided a method comprising receiving a first input signal and a second input signal; estimating a noise correlation statistic between the first input signal and the second input signal; estimating an inter sensor signal model representative of a relationship between desired signal components present in the first input signal and the second input signal; wherein responsive to the noise correlation statistic meeting a predefined condition, the step of estimating is based on the noise correlation statistic; and responsive to the noise correlation statistic not meeting the predefined condition, the step of estimating is based on a constrained noise correlation statistic derived from the noise correlation statistic.

According to some embodiments, there is provided a processor comprising: a first input configured to receive a first input signal and a second input configured to receive a second input signal; a noise correlation determination block configured to estimate a noise correlation statistic between the first input signal and the second input signal; an inter sensor signal model estimator configured to estimate an inter sensor signal model representative of a relationship between desired signal components present in the first input signal and the second input signal; wherein responsive to the noise correlation statistic meeting a predefined condition, the inter sensor signal model estimator is configured to estimate the inter sensor signal model based on the noise correlation statistic; and responsive to the noise correlation statistic not meeting the predefined condition, the inter sensor signal model estimator is configured to estimate the inter sensor signal model based on a constrained noise correlation statistic derived from the noise correlation statistic.

BRIEF DESCRIPTION OF THE DRAWINGS

For a better understanding of the embodiments of the present disclosure, and to show how it may be put into effect, reference will now be made, by way of example only, to the accompanying drawings, in which.

DESCRIPTION

The description below sets forth example embodiments according to this disclosure. Further example embodiments and implementations will be apparent to those having ordinary skill in the art. Further, those having ordinary skill in the art will recognize that various equivalent techniques may be applied in lieu of, or in conjunction with, the embodiment discussed below, and all such equivalents should be deemed as being encompassed by the present disclosure.

When noise remains correlated between microphones, a speech signal may be obtained by processing the microphone inputs. A processor for example comprising an adaptive filter that processes signals by maintaining a noise correlation statistic is illustrated in FIG. 2.

Figure 2:
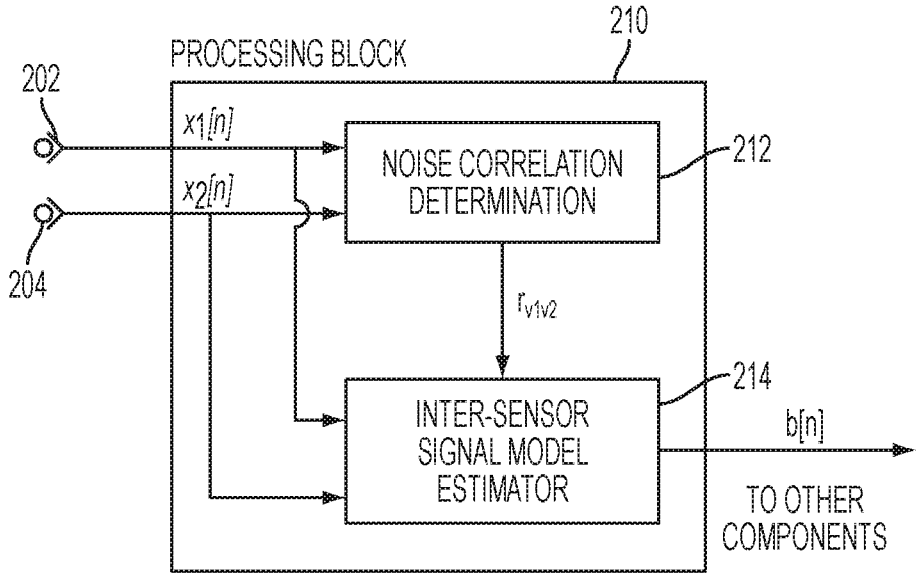
FIG. 2 illustrates an example block diagram illustrating a processor that determines a noise correlation statistic according to embodiments of the disclosure.

FIG. 2 is an example block diagram illustrating a processor that determines a noise correlation statistic according to one embodiment of the disclosure. The processing block 210 may comprise an adaptive blocking matrix. The processing block 210 receives a first input signal $x_1[n]$ and a second input signal $x_2[n]$ from input nodes 202 and 204, which may be coupled to, for example, a first microphone and a second microphone respectively. The first input signal $x_1[n]$ and second input signal $x_2[n]$ are provided to a noise correlation determination block 212 and an inter sensor signal model estimator 214. The inter sensor signal model estimator 214 also receives a noise correlation statistic $r_{v1v2}$ between any two noise signals $v_1[n]$ and $v_2[n]$ where vi[n] is the noise component present in the microphone signal xi[n] calculated by the noise correlation determination block 212.

The inter sensor signal model estimator 214 may be configured to estimate an inter sensor signal model, $h_{est}[n]$, representative of a relationship between desired signal components present in the first input signal $x_1[n]$ and the second input signal $x_2[n]$.

The inter sensor signal model estimator 214 may implement a learning algorithm, such as a normalized least means square (NLMS) algorithm or a gradient total least squares (GrTLS) algorithm, to generate a noise signal b[n] that may be provided to further processing blocks or other components. The further processing blocks or other components may use the b[n] signal to generate, for example, a speech signal with reduced noise when compared to that received at the first microphone or the second microphone individually.

In some examples, responsive to the noise correlation statistic meeting a predefined condition, the inter sensor signal model estimator estimates the inter sensor signal model based on the noise correlation statistic; and responsive to the noise correlation statistic not meeting the predefined condition, the inter sensor signal model estimator estimates the inter sensor signal model based on a constrained noise correlation statistic derived from the noise correlation statistic.

In particular, the noise correlation statistic may comprise a normalized noise cross correlation, $r_v$, between the first input signal and the second input signal.

A noise correlation matrix that is used to estimate the inter-sensor model is further constructed using the calculated noise correlation function. The square root inverse of this noise correlation may be used to derive an online update method for estimating the inter-sensor model parameters. The square root inverse of this correlation matric may be efficiently approximated when:

$$\frac{\rho r_{v2v1}^{T} r_{v2v1}}{4} \approx 0;$$

where

ρ is a tuning parameter. Inverting a large matrix in real time may be expensive and therefore undesirable.

However, when the first sensor and second sensor providing the first sensor signal and second sensor signal are too close together, for example sensors (or microphones) in headsets or smart home devices having small profiles that restrict the spacing between sensors, this approximation may no longer be valid, and the filter coefficients of the inter sensor signal model calculated based on the noise correlation statistic may diverge. In order to account for this potential divergence in the calculation of the inter sensor signal model, a constrained noise correlation statistic may be used when it is determined that the noise correlation statistic is representative of microphones that are not closely located.

For example, the predefined condition may comprise a maximum threshold, λ, for the energy of the normalized noise cross correlation. This condition may be met when the sensors are closely located. In other words, when the energy of the normalized cross correlation increases above the maximum threshold, this condition may be indicative of the sensors no longer being closely located.

The predefined condition may be written as $r_{v1v2}{}^{T} r_{v1v2} \leq \lambda$ where λ is a value less than or equal to 1. The predefined condition may also be expressed as:

$$\|r_{v1v2}\|_2 = \lambda^{1/2}.$$

In some examples, the predefined condition may further comprise that $\max[r_{v1v2}] < \gamma$, which may also be expressed as $L_\infty$ norm of the noise correlation not exceeding a threshold.

As previously mentioned, responsive to the noise correlation statistic not meeting the predetermined condition, a constrained noise correlation statistic may be used to estimate the inter sensor signal model $h_{est}[n]$.

The constrained noise correlation statistic may be derived from the noise correlation statistic by rescaling the noise correlation statistic by $L_\infty$ norm of the noise correlation statistic. In some examples, therefore the constrained normalized cross correlation $r_{v1v2}^{(c)}$ may be calculated as:

$$r_{v1v2}^{(c)} = \frac{r_{v1v2}}{\max[r_{v1v2}]}\gamma.$$

Figure 3:
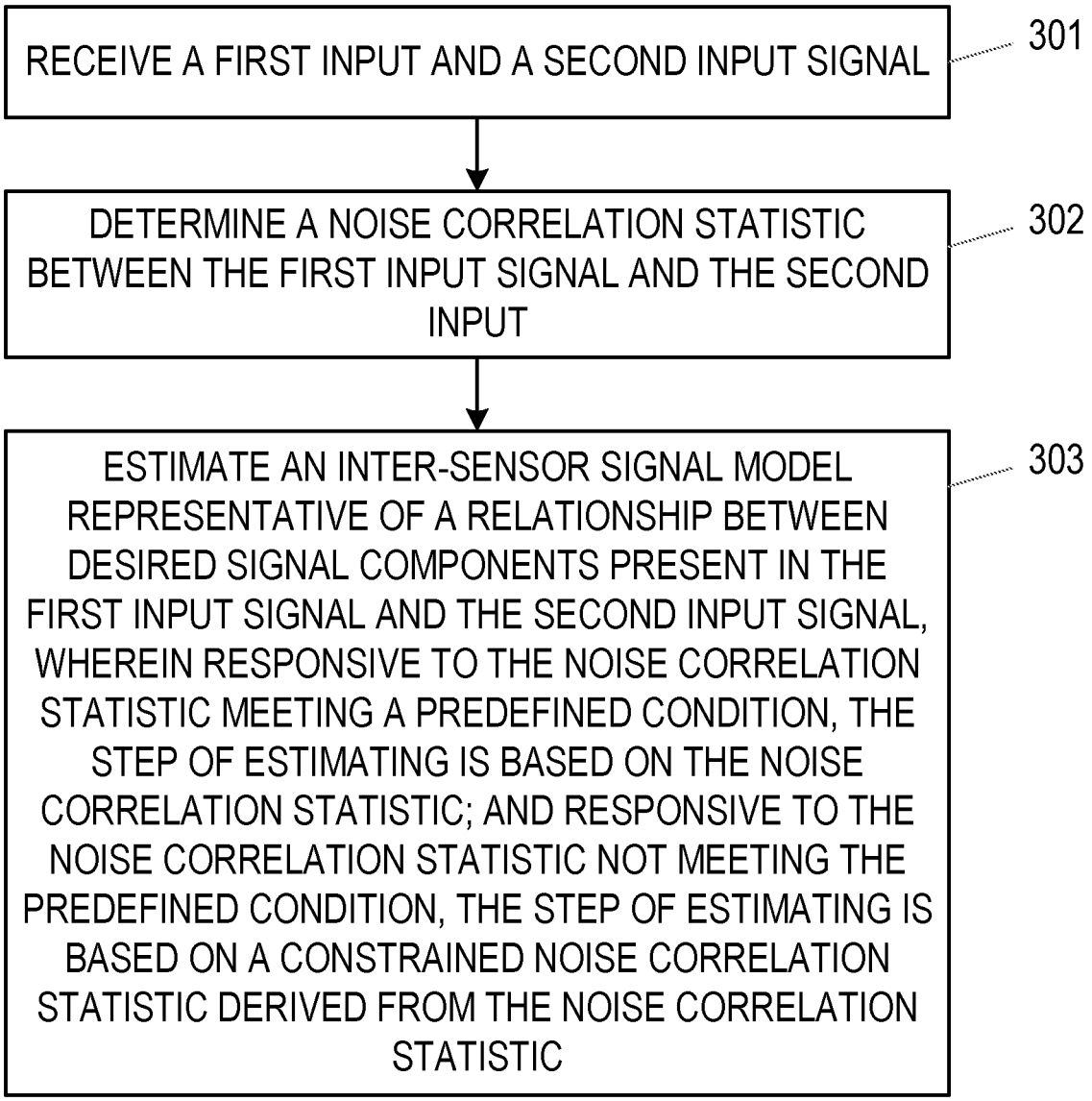
FIG. 3 illustrates an example flow chart for processing sensor signals with a learning algorithm according to one embodiment of the disclosure.

An example of a method of processing the microphone signals to improve noise correlation in an adaptive blocking matrix is shown in FIG. 3. FIG. 3 is an example flow chart for processing sensor signals with a learning algorithm according to embodiments of the disclosure.

In step 301, the method comprises receiving a first input signal and a second input signal, such as from a first microphone and a second microphone, respectively, of a device.

In step 302, the method comprises determining a noise correlation statistic between the first input signal and the second input signal.

In step 303, the method comprises estimating an inter sensor signal model representative of a relationship between desired signal components present in the first input signal and the second input signal. The estimated inter sensor model may be based on the determined noise correlation statistic of step 302 and applied in an adaptive blocking matrix to maintain noise correlation between the first input and the second input as the first input and the second input are being processed. For example, by maintaining noise correlation between the a[n] and b[n] signals, or more generally maintaining correlation between an input to an adaptive noise canceler block and an output of the adaptive blocking matrix. In particular, responsive to the noise correlation statistic meeting a predefined condition, step 303 is based on the noise correlation statistic. Responsive to the noise correlation statistic not meeting the predefined condition, the step of estimating is based on a constrained noise correlation statistic derived from the noise correlation statistic, as described above.

In some examples, more than two sensor input signals are received. In these examples, a noise correlation statistic may be calculated for each pair of sensor input signals, and the method may be performed for each pair of sensor input signals. For example, the method of FIG. 3 may further comprise receiving a third input signal; estimating a second noise correlation statistic between the third input signal and the second input signal; estimating a second inter sensor signal model representative of a relationship between desired signal components present in the third input signal and the second input signal; wherein responsive to the second noise correlation statistic meeting a predefined condition, the step of estimating the second inter sensor signal model is based on the second noise correlation statistic; and responsive to the second noise correlation statistic not meeting the predefined condition, the step of estimating the second inter sensor signal model is based on a second constrained noise correlation statistic derived from the second noise correlation statistic.

In some examples, the method of FIG. 3 further comprises applying the inter sensor signal model to one of the first input signal and the second input signal to generate a modelled signal; comparing the modelled signal to another of the first input signal and the second input signal to generate a noise signal; and using the noise signal or a signal derived therefrom, to perform adaptive noise cancellation on a beamformed signal derived from at least the first input signal and the second input signal.

The processing of the sensor input signals by an adaptive blocking matrix in accordance with such a learning algorithm is illustrated by the processing models shown in FIG. 4, FIG. 5, FIG. 6, and FIG. 7.

Figure 4:
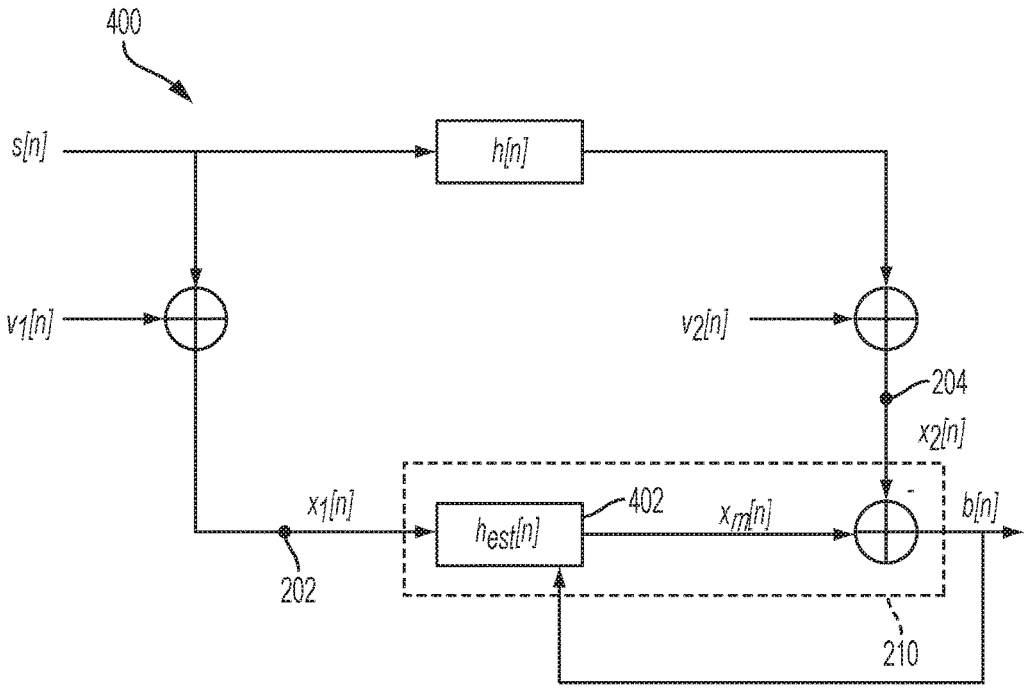
FIG. 4 is an example model of signal processing for adaptive blocking matrix processing according to embodiments of the disclosure.

FIG. 4 is an example model of signal processing for adaptive blocking matrix processing according to one embodiment of the disclosure. In an adaptive beamformer, the main aim of the blocking matrix is to estimate the system h[n] with the inter sensor signal model hest[n] such that the desired directional signal s[n] may be cancelled through a subtraction process. A desired signal s[n] may be detected by two (or more) sensors, for example microphones, in which each sensor experiences different noises, of which the noises are illustrated as v1[n] and v2[n]. Input nodes 202 and 204 of FIG. 4 indicate the signals as received at the adaptive block matrix 210 from the first sensor and the second sensor, i.e. signals x1[n] and x2[n], respectively. The system h[n] is represented as added to the desired directional signal as part of the received signal. Although h[n] is shown being added to the desired directional signal s[n], when a digital signal processor receives the second input signal x2[n] from a sensor, the h[n] signal is generally an inseparable component of the second input signal x2[n] combining the noise signal v2[n] with the speech signal s[n]. The adaptive blocking matrix 210 then generates an inter sensor signal model 402 that estimates the system h[n]. Thus, when hest[n] is added to the first input signal x1[n], and the second input signal x2[n] is subtracted from the modelled signal output from the inter sensor signal model $x_m[n]$ in processing block 210, the noise signal b[n] generated by the subtracted has cancelled out the desired directional signal s[n]. The additive noises v1[n] and v2[n] may be correlated with each other, and the degree of correlation depends on the microphone spacing.

The unknown system h[n] may be estimated in hest[n] using an inter sensor signal model, for example an adaptive filter. In particular the inter sensor signal model may also estimate $h_{est}[n]$ based on the output noise signal b[n]. The inter sensor signal model coefficients may be updated using a classical normalized least means squares (NLMS) as shown in the following equation:

$$h_{k+1} = h_k + \frac{\mu}{x_k^T x_k + \delta} b[k] x_k, \text{ where}$$

$$x_k = [x_1[k], x_1[k-1] \ldots x_1[k-L+1]]^T,$$

represents past and present samples of signal x1[n], and L is a number of finite impulse response (FIR) filter coefficients that may be adjusted, and μ is the learning rate that may be adjusted based on a desired adaptation rate. The depth of convergence of the NLMS-based filter coefficients estimate may be limited by the correlation properties of the noise present in signals x1[n] (which in this example is treated as the reference signal) and x2[n] (which is treated as the input signal).

The coefficients of the inter sensor signal model 402 of system 400 may alternatively be calculated based on a total least squares (TLS) approach, such as when the observed (both reference and input) signals are corrupted by uncorrelated white noise signals. In one embodiment of a TLS approach, a gradient-descent based TLS solution (GrTLS) is given by the following equation:

$$h_{k+1} = h_k + \frac{2\mu b[k]}{(1 + h_k^T h_k)}\left[x_k + \frac{b[k]h_k}{(1 + h_k^T h_k)}\right].$$

The type of the learning algorithm implemented by a digital signal processor, such as either NLMS or GrTLS, for estimating the filter coefficients may be selected by a user or a control algorithm executing on a processor. The depth of converge improvement of the TLS solution over the LS solution may depend on the signal-to-noise ratio (SNR) and the maximum amplitude of the impulse response.

A TLS learning algorithm may be derived based on the assumption that the additive noises v1[n] and v2[n] are both temporally and spatially uncorrelated. However, the noises may be correlated due to the spatial correlation that exists between the microphone signals and also the fact that acoustic background noises are not spectrally flat (i.e. temporally correlated). This correlated noise may result in insufficient depth of convergence of the learning algorithms.

The effects of temporal correlation may be reduced by applying a fixed pre-whitening filter on the signals x1[n] and x2[n] received from the microphones.

Figure 5:
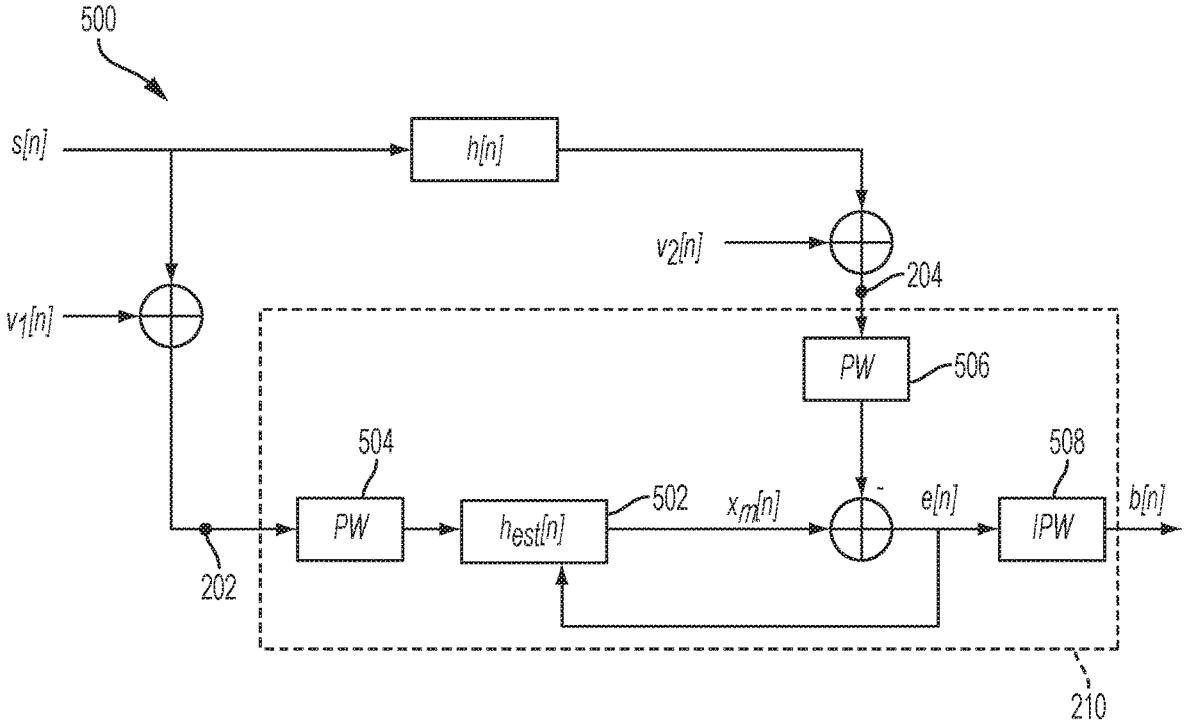
FIG. 5 is an example model of signal processing for adaptive blocking matrix processing according to embodiments of the disclosure.

FIG. 5 illustrates an example model of signal processing for adaptive blocking matrix processing with a pre-whitening filter according to one embodiment of the disclosure. Pre-whitening (PW) blocks 504 and 506 may be added to processing block 210. The PW blocks 504 and 506 may apply a pre-whitening filter to the microphone signals x1[n] and x2[n], respectively, to obtain signals y1[n] and y2[n] which then form the first input signal and second input signal respectively. The noises in the corresponding pre-whitened signals may be represented as q1[n] and q2[n], respectively. The pre-whitening (PW) filter may be implemented using a first order finite impulse response (FIR) filter. In one embodiment, the PW blocks 504 and 506 may be adaptively modified to account for a varying noise spectrum in the signals x1[n] and x2[n]. In another embodiment, the PW blocks 504 and 506 may be fixed pre-whitening filters.

The PW blocks 504 and 506 may apply spatial and/or temporal pre-whitening. The selection of using either the spatial pre-whitened based update equations or other update equations may be controlled by a user or by an algorithm executing on a controller. In one embodiment, the temporal and the spatial pre-whitening process may be implemented as a single step process using the complete knowledge of the square root inverse of the correlation matrix. In another embodiment, the pre-whitening process may be split into two steps in which the temporal pre-whitening is performed first followed by the spatial pre-whitening process. The spatial pre-whitening process may be performed by approximating the square root inverse of the correlation matrix. In another embodiment, the spatial pre-whitening using the approximated square root inverse of the correlation matrix is embedded in the coefficient update step of the inter-signal model estimation process.

After applying an inter sensor signal mode 502, which may be similar to the inter sensor signal model 402 describer with reference to FIG. 4, and combining the signals to form noise signal e[n], the filtering effect of the pre-whitening process may be removed in an inverse pre-whitening (IPW) block 508, such as by applying an IIR filter on the signal e[n] to generate the signal b[n]. In one embodiment, the numerator and denominator coefficients of the PW filter is given by (a0=1, a1=0, b0=0.9, b1=−0.7) and of IPW filter is given by (a0=0.9, a1=−0.7, b0=1, b1=0), where ai's and bi's are the denominator and numerator coefficients of an IIR filter. The output of the IPW block 508 is the b[n] signal.

The effects of the spatial correlation may be addressed by decorrelating the noise using a decorrelating matrix that may be obtained from the spatial correlation matrix. Instead of explicitly decorrelating the signals, the cross-correlation of the noise may be included in the cost function of the minimization problem and a gradient descent algorithm that is a function of the estimated cross-correlation function may be derived for any learning algorithm selected for the inter sensor signal model estimator 402.

For example, for a TLS learning algorithm, coefficients for the inter sensor signal model estimator 402 may be computed from the following equation:

$$h_{k+1} = h_k + \frac{2\mu b[k]}{(1 + h_k^T h_k)}\left[x_1[k] + \frac{b[k]h_k}{(1 + h_k^T h_k)}\right] - \frac{\mu}{\sigma^{1.5}(1 + h_k^T h_k)}\left[x_2[k]b[k]r_{v1v2} + x1r_{v1v2}^T(\underline{x}_1[k] - x_2[k]h_k) + \frac{2hb[k]r_{v1v2}^T(\underline{x}_1[k] - x_2[k]h_k)}{(1 + h_k^T h_k)}\right]. \quad (1)$$

It will be appreciated that, for the example given in FIG. 5, the coefficients for the inter sensor signal model 502 may be calculated in a similar manner where, $\underline{x}_1[k]$ may be replaced by $\underline{y}_1[k]$, b[k] may be replaced by e[k], $x_2[k]$ may be replaced by y[k], x1 may be replaced by y1 and the noise correlation statistic $r_{v1v2}$ may be $r_{q1q2}\cdot\sigma$ is the standard deviation of the background noise which may be computed by taking the square root of the average noise power.

As another example, for a LS learning algorithm, coefficients for the inter sensor signal model 402 may be computed from the following equation:

$$h_{k+1} = h_k + 2\mu b[k]x_1 - \frac{\mu}{\sigma^{1.5}}[x_1 r_{v1v2}^T(x_1 - x_2[k]h_k) + x_2[k]b[k]r_{v1v2}]. \quad (2)$$

The smoothed standard deviations may then be obtained from the following equation:

$$\sigma[l]=\alpha\sigma[l-1]+(1-\alpha)\sqrt{E[l]},$$

where E[l] is the averaged noise power and α is the smoothing parameter.

In general, the background noises arrive from far field, and therefore the noise power at both microphones may be assumed to have the same power. Thus, the noise power from either one of the microphones may be used to calculate E[l]. The smoothed noise cross-correlation estimate of $r_{v1v2}$ is obtained as:

$$r_{v1v2}[m, l] = \beta r_{v1v2}[m, l-1] + (1-\beta)\hat{r}_{v1v2}[m, l], \text{ where}$$

$$r_{v1v2}[m, l] = \frac{1}{N}\Sigma_{n=0}^{N-1} v_2[n, l]v_1[n-m, l]; \text{ and}$$

$$m = D - M, \ldots, D + M - 1, D + M,$$

where m is the cross-correlation delay lag in samples, N is the number of samples used for estimating the cross-correlation and may be set to 256 samples, I is the super-frame time index at which the noise buffers of size N samples are created, D is the causal delay introduced at the input x2[n], and β may be an adjustable smoothing constant.

Referring back to FIG. 2, the noise correlation statistic $r_{v1v2}$ described above may be computed by the noise correlation determination block 212.

The noise correlation statistic may be insignificant as lag increases. In order to reduce the computational complexity, the cross-correlation corresponding to only a select number of lags may be computed. The maximum cross-correlation lag M may thus be adjustable by a user or determined by an algorithm. A larger value of M may be used in applications in which there are fewer number of noise sources, such as a directional, interfering, competing talker or if the microphones are spaced closely to each other.

In some examples, the estimation of the noise correlation statistic during the presence of desired speech may corrupt the estimate of the noise correlation statistic, thereby affecting the desired speech cancellation performance. Therefore, the buffering of data samples for cross-correlation computation and the estimation of the smoothed cross-correlation may be enabled at only particular times and may be disabled, for example, when there is a high confidence in detecting the absence of desired speech.

In other words, the noise correlation statistic is estimated from the first input signal and the second input signal when there are no desired signal components in the first input signal and the second input signal. For example, the method of FIG. 3 may further comprise determining that there are no desired signal components by: detecting whether the first input signal or the second input signal comprise signal components indicative of voice using a voice activity detector.

Figure 6:
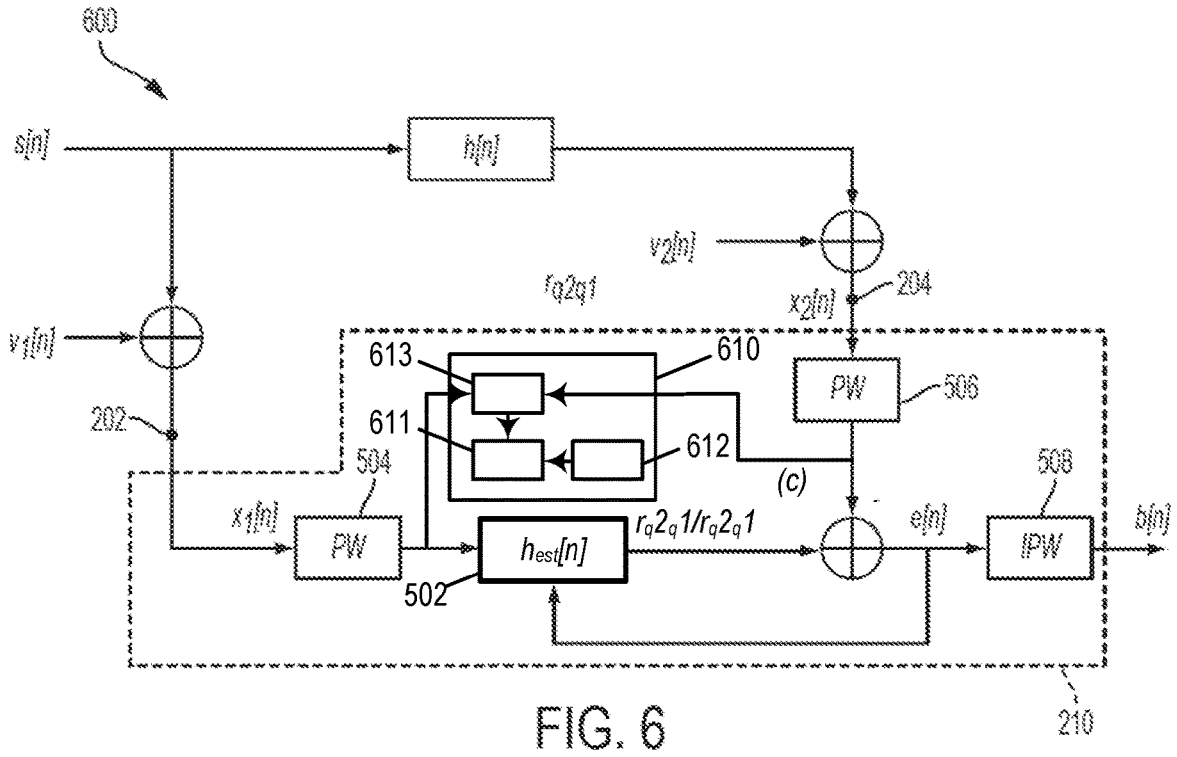
FIG. 6 is an example model of signal processing for adaptive blocking matrix processing with a pre-whitening filter prior to noise correlation determination according to one embodiment of the disclosure.

FIG. 6 is an example model of signal processing for adaptive blocking matrix processing with a pre-whitening filter prior to noise correlation determination according to one embodiment of the disclosure. System 600 of FIG. 6 is similar to system 500 of FIG. 5, but includes noise correlation determination block 610. Noise correlation determination block 610 may receive, as input, the pre-whitened microphone signals from blocks 504 and 506 although it will be appreciated that the noise correlation determination block may receive input signals that have not been pre-whitened, as illustrated in FIG. 4. Noise correlation determination block 610 may output, to the inter sensor signal model estimator 502, a noise correlation parameter, such as $r_{q2q1}$.

As described previously, if the noise correlation parameter $r_{q2q1}$ meets the predefined condition, the inter sensor signal model estimator 502 may utilize the noise correlation parameter $r_{q2q1}$ to determine the inter sensor signal model. However, if the noise correlation parameter $r_{q2q1}$ does not meet the predefined condition, the inter sensor signal model estimator 502 may utilize a constrained noise correlation parameter which may be calculated as described above.

In this example, therefore, the noise correlation determination block 610 comprises a correlation condition check block 611 configured to receive the noise correlation parameter $r_{q2q1}$ calculated by parameter block 613, and to determine whether the appropriate predefined condition is met. The correlation condition check block 611 may then output to the inter-sensor signal model either the noise correlation parameter $r_{q2q1}$ when the predefined condition is met, or the constrained noise correlation parameter $r_{q2q1}^{(c)}$ calculated by a constrained parameter block 612 when the predefined condition is not met.

Figure 7:
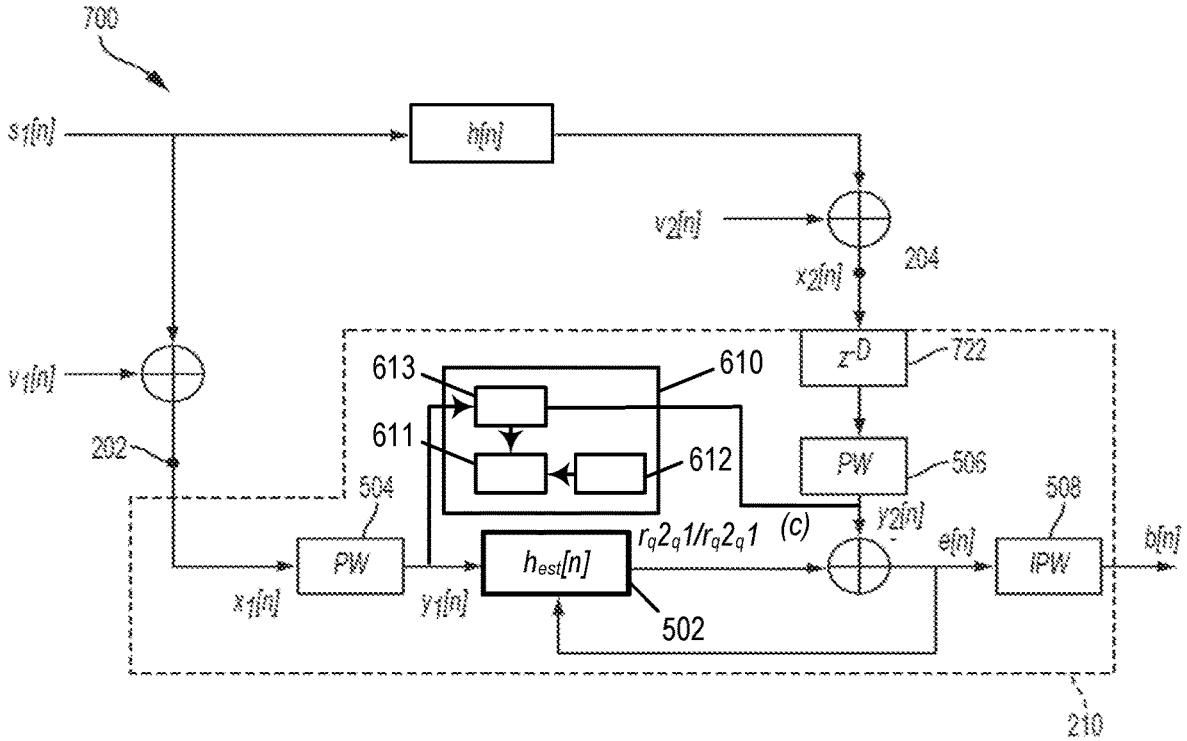
FIG. 7 is an example model of signal processing for adaptive blocking matrix processing with a pre-whitening filter and delay according to one embodiment of the disclosure.

FIG. 7 is an example model of signal processing for adaptive blocking matrix processing with a pre-whitening filter and delay according to one embodiment of the disclosure. System 700 of FIG. 7 is similar to system 600 of FIG. 6, but includes a delay block 722. Depending on the direction of arrival of the desired signal and the selected reference signal, the impulse response of the system h[n] may result in an acausal system. This acausal system may be estimated in the implementation by introducing a delay ($z^{-D}$) block 722 at an input of the inter sensor signal model estimator 502, such that the estimated impulse response is a time shifted version of the true system. The delay at block 722 introduced at the input may be adjusted by a user or may be determined by an algorithm executing on a controller.

Figure 8:
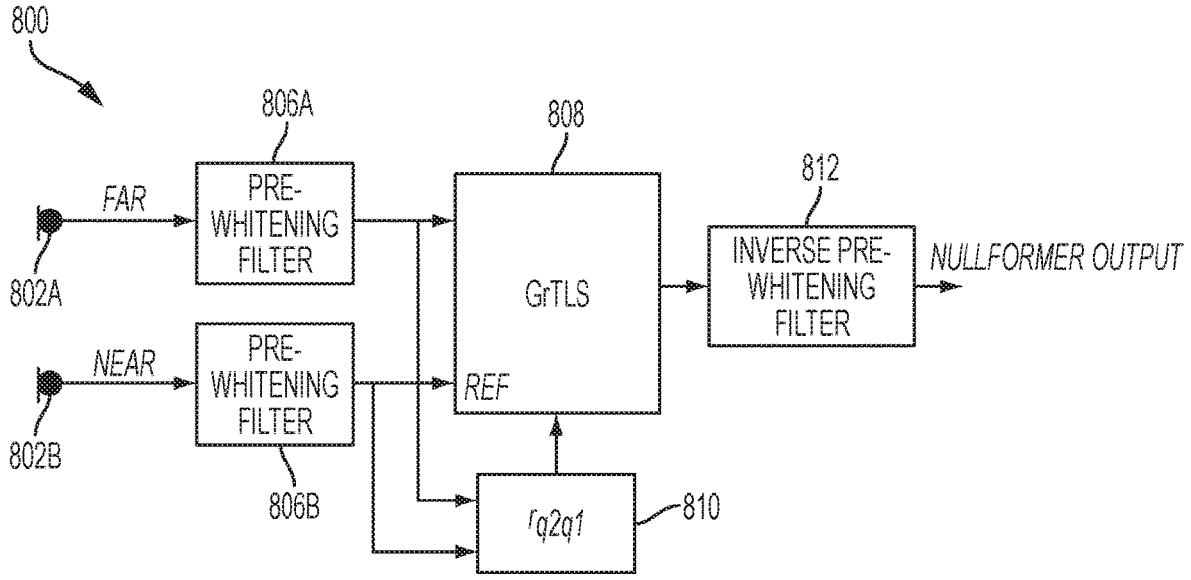
FIG. 8 is an example block diagram of a system for executing a gradient decent total least squares (TLS) learning algorithm according to one embodiment of the disclosure.

A system for implementing one embodiment of a signal processing block is shown in FIG. 8. FIG. 8 is an example block diagram of a system for executing a gradient descent total least squares (TLS) learning algorithm according to one embodiment of the disclosure. A system 800 includes noisy signal sources 802A and 802B, such as digital microelectromechanical systems (MEMS) microphones. The noisy signals may be passed through pre-temporal whitening filters 806A and 806B, respectively. Although two filters are shown, in one embodiment a pre-whitening filter may be applied to only one of the signal sources 802A and 802B. The pre-whitened signals are then provided to a correlation determination module 810 and a gradient descent TLS module 808. The modules 808 and 810 may be executed on the same processor, such as a digital signal processor (DSP). The correlation determination block 810 may determine the parameter $r_{q2q1}$ or $r_{q1q2}^{(c)}$ when the predefined condition is met or not met, such as described above, which is provided to the GrTLS module 808. The GrTLS module 808 then generates a signal representative of the speech signal received at both of the input sources 802A and 802B. That signal is then passed through an inverse pre-whitening filter 812 to generate the signal received at the sources 802A and 802B. Further, the filters 806A, 806B, and 812 may also be implemented on the same processor, or digital signal processor (DSP), as the GrTLS block 808.

In the above examples for estimating the coefficients for the inter sensor signal model estimator, for example adaptive filters 402 and 502, in some examples, the at least one coefficient of the inter sensor signal model may be updated every two samples of the received first input signal and second input signal. In other words, by utilising a dual multiply and accumulator (MAC) computational block, the coefficients of the inter sensor signal mode may be updated by performing two MAC operations in a single instruction cycle.

In addition to the dual MAC feature, it is possible to further reduce the processing requirement by using the dual sample update method in which the coefficients are updated once in two samples instead of every sample. Specifically, the dual sample update may be a logical choice, since the errors b[k] and b[$k$+1] are calculated in the same iteration using the dual MAC feature. In other words, the finite impulse response filtering needed to calculate the two error signal samples may be implemented concurrently using the dual MAC feature, i.e.

$$b[k]=x_2[k]-h^T x_{1,k}, \text{FIR1,MAC1}$$

$$b[k+1]=x_2[k+1]-h^T x_{1,k+1}, \text{FIR2,MAC2.}$$

With the dual sample update process, the convergence path is expected to be different from the single sample update method. However, empirical results show that this difference did not affect the convergence depth of the modelled impulse response.

For example, equation (1) above may be written as:

$$h_{k+1} = h_k + \mu'[k][a_1[k]\underline{x}_1[k] - a_2[k]\tilde{r}_{v_2v_1} + a_3[k]h_k], \text{ where}$$

$$\mu'[k] = \frac{\mu}{(1 + h_k^T h_k)^2};$$

$$a_1[k] = (2b[k] - c[k])(1 + h_k^T h_k);$$

$$a_2[k] = (x_2[k]b[k])(1 + h_k^T h_k);$$

$$a_3[k] = 2b[k]\{b[k] - c[k]\};$$

$$c[k] = x_{1,k}^T \tilde{r}_{v_2v_1} - x_2[k]h_k^T \tilde{r}_{v_2v_1}; \text{ and}$$

$$\tilde{r}_{v_2v_1} = \frac{r_{v_2v_1}}{\sigma_v^{1.5}}$$

The coefficients may then be updated once every two samples. The sample update equation at time step (k+2) as a function of sample update at time step k is given by $$h_{k+2}=h_k+\mu'[k][a_1[k]x_{1,k}+a_1[k+1]x_{1,k+1}-a_2[k,k+1]\tilde{r}_{v_2v_1}+a_3[k,k+1]h_k]$$

where $$a_1[k+1]=(2b[k+1]-c[k+1])(1+h_k^T h_k).$$

$$c[k+1]=x_{1,k+1}^T\tilde{r}_{v_2v_1}-x_2[k+1]h_k^T\tilde{r}_{v_2v_1}$$

$$a_2[k,k+1]=(x_2[k]b[k]+x_2[k+1]b[k+1])(1+h_k^T h_k)$$

$$a_3[k,k+1]=2b[k]\{b[k]-c[k]\}+2b[k+1]\{b[k+1]-c[k+1]\}$$

Given the above sample update equation, two adjacent coefficients may then be updated as:

$$h_{k+2}[i]=h_k[i]+\mu'[k][a_1[k]x_{1,k}[i]+a_1[k+1]x_{1,k+1}[i]-a_2[k,k+1]\tilde{r}_{v_2v_1}[i]+a_3[k,k+1]h_k[i]]; \text{ and}$$

$$h_{k+2}[i+1]=h_k[i+1]+\mu'[k][a_1[k]x_{1,k}[i+1]+a_1[k+1]x_{1,k+1}[i+1]-a_2[k,k+1]\tilde{r}_{v_2v_1}[i+1]+a_3[k,k+1]h_k[i+1]];$$

where $x_{1,k}[i]$ and $x_{1,k+1}[i+1]$ refer to the same sample.

A similar process may be performed for equation (2) above, i.e. using the NLMS algorithm.

For example equation (2) may be written as $$h_{k+1}=h_k+\mu[a_1[k]\underline{x}_{1,k}-a_2[k]\tilde{r}_{v_2v_1}];$$

where $$a_1[k]=2b[k]-x_{1,k}^T\tilde{r}_{v_2v_1}+x_2[k]h_k^T\tilde{r}_{v_2v_1}$$

$$a_2[k]=x_2[k]b[k]$$

and $$h_{k+2}=h_k+\mu[a_1[k]x_{1,k}+a_1[k+1]x_{1,k+1}-a_2[k,k+1]\tilde{r}_{v_2v_1}];$$

where $$a_1[k+1]=2b[k+1]-x_{1,k}^T\tilde{r}_{v_2v_1}+x_2[k+1]h_k^T\tilde{r}_{v_2v_1}; \text{ and}$$

$$a_2[k,k+1]=x_2[k]b[k]+x_2[k+1]b[k+1].$$

The two coefficients may then be updated as:

$$h_{k+2}[i]=h_k[i]+\mu[a_1[k]x_{1,k}[i]+a_1[k+1]x_{1,k+1}[i]-a_2[k,k+1]\tilde{r}_{v_2v_1}[i]]; \text{ and}$$

$$h_{k+2}[i+1]=h_k[i+1]+\mu'[a_1[k]x_{1,k}[i+1]+a_1[k+1]x_{1,k+1}[i+1]-a_2[k,k+1]\tilde{r}_{v_2v_1}[i+1]]$$

Figure 9:
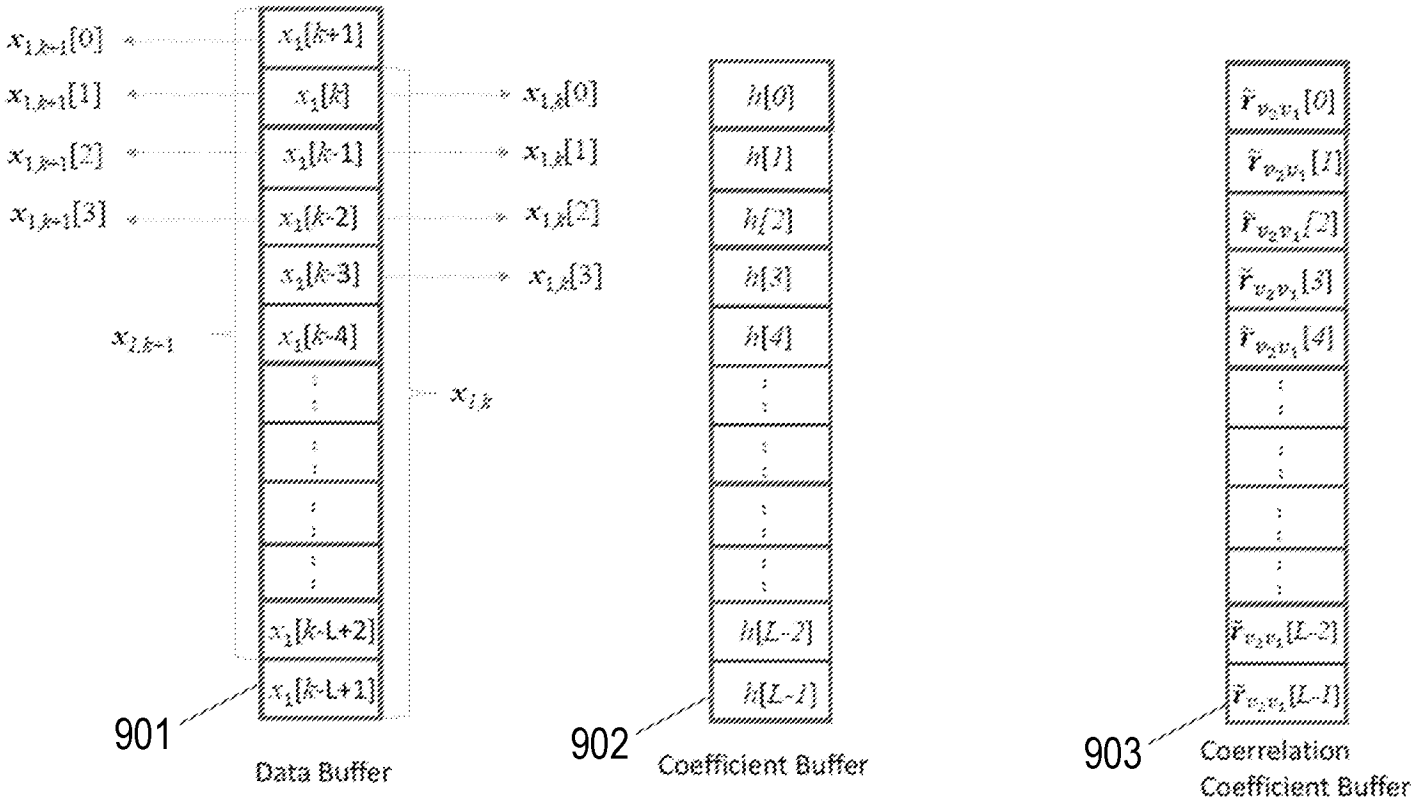
FIG. 9 illustrates an example of a data buffer 901, coefficient buffer 902 and correlation coefficient buffer 903 to be used by a dual MAC computational block according to embodiments of the disclosure.

FIG. 9 illustrates an example of a data buffer 901, coefficient buffer 902 and correlation coefficient buffer 903 to be used by the dual MAC computational block according to embodiments of the disclosure.

In general, the one or more coefficients of the inter sensor signal model may be updated online.

Figure 1:
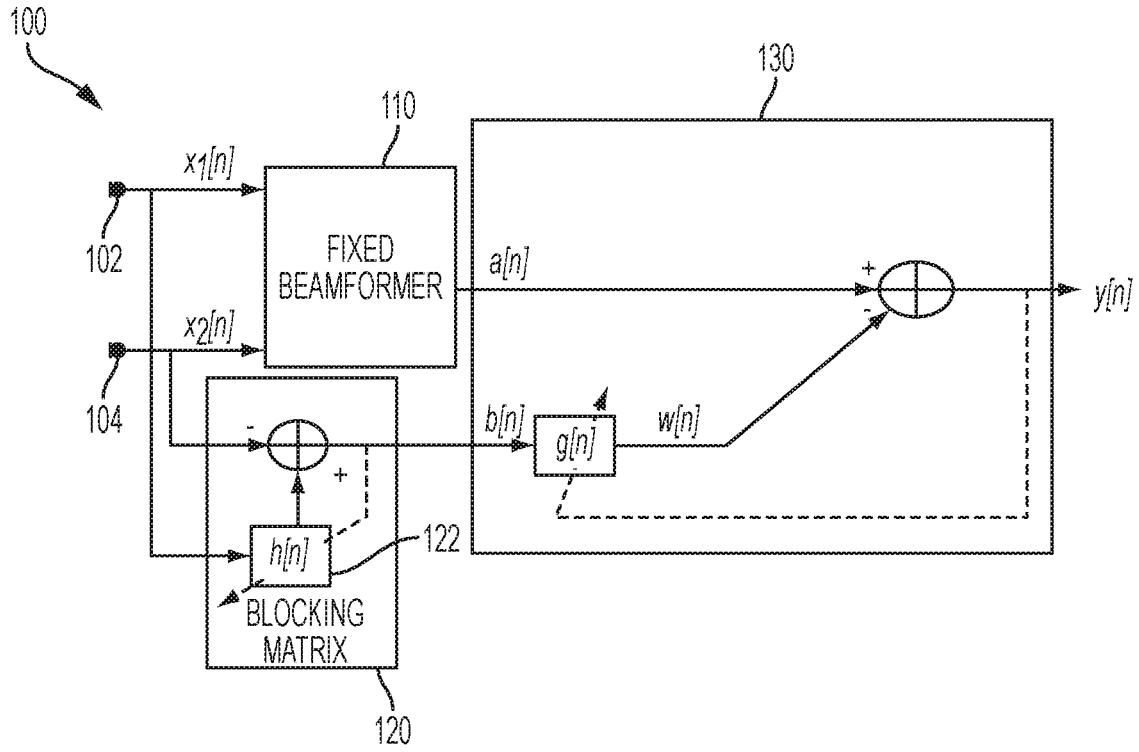
FIG. 1 PRIOR ART
FIG. 1 illustrates an example of an adaptive beamformer according to the prior art.

The adaptive blocking matrix and other components and methods described above may be implemented in a device, such as a mobile device or smart home device, to process signals received from near and/or far microphones or sensors of the device. The device may be, for example, a mobile phone, a tablet computer, a laptop computer, a wireless earpiece or a smart home device. A processor of the device, such as the device's application processor, may implement an adaptive beamformer, an adaptive blocking matrix, an adaptive noise canceller, a processing block 210 such as those described above with reference to FIG. 2, FIG. 3, FIG. 4, FIG. 5, FIG. 6, FIG. 7 or FIG. 8, or other circuitry for processing. Alternatively, the device may include specific hardware for performing these functions, such as a digital signal processor (DSP) or other circuitry. Further, the processor or DSP may implement the system of FIG. 1 with a modified adaptive blocking matrix as described in the embodiments and description above.

A smart home device is an electronic device configured to receive user speech input, process the speech input, and take an action based on the recognized voice command.

Figure 10:
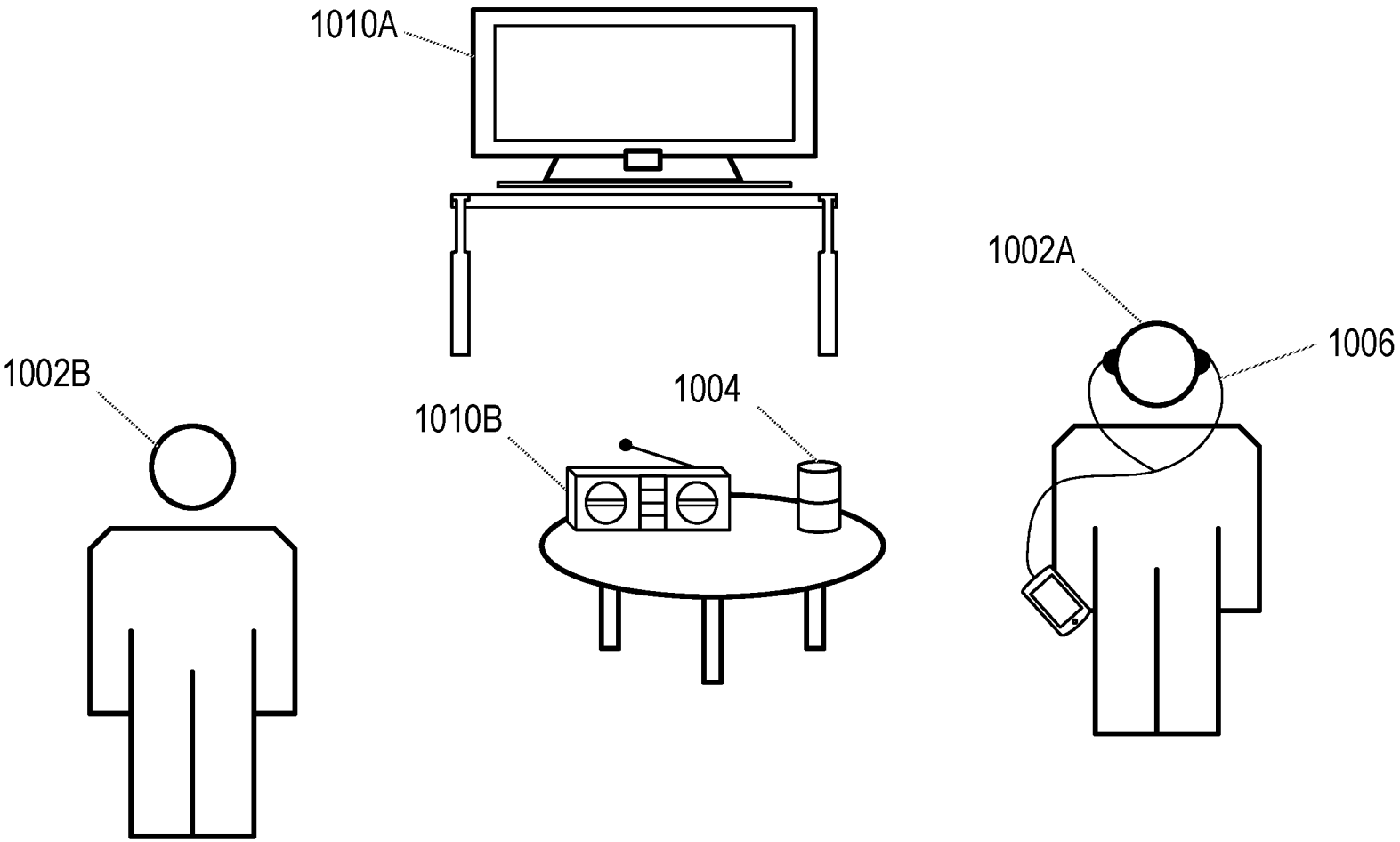
FIG. 10 illustrates a smart home device and a personal device in a room.

An example smart home device in a room is illustrated in FIG. 10. For example, room may include a smart home device 1004. The smart home device 1004 in this example may include at least two microphones, a speaker, and electronic components for receiving speech input. Individuals 1002A and 1002B may be in the room and communicating with each other or speaking to the smart home device 1004. Individuals 1002A and 1002B may be moving around the room, moving their heads, putting their hands over their faces, or taking other actions that change how the smart home device 1004 receives their voices. Also, sources of noise or interference, audio signals that are not intended to activate the smart home device 1004 or that interfere with the smart home device 1004's reception of speech from individuals 1002A and 1002B, may exist in the room. Some example sources of interference that are illustrated include sounds from a television 1010A and a radio 1010B. Other sources of interference not illustrated may include noises from washing machines, dish washers, sinks, vacuums, microwave ovens, music systems, etc.

In this example, the smart home device 1004 comprises a processing block 210, for example the processing block 210 as illustrated in FIG. 2. Without the proposed processing block 210, for example, as illustrated in FIG. 2, the smart home device 1004 may have incorrectly processed voice commands because of the interference sources. Speech from the individuals 1002A and 1002B may not have been recognizable by the smart home device 1004 because the amplitude of interference drowns out the individual's speech.

However, by utilising the processing block 210 to process the received signals from the at least two microphones, the smart home device 1004 is able to process the received signals to determine voice commands and to remove the interfering noise signals.

Furthermore, it may be preferable for the design of the smart home device 1004 to be physically small in terms of size, which may therefore require the at least two microphones to be closely spaced. The implementation of the proposed embodiments in such a smart home device 1004 may therefore be used to overcome the issues regarding the noise interference, as well as the small size of the smart device requiring the microphones to be closely spaced.

FIG. 10 also illustrates a personal device 1006 The personal device 1006 may comprise any suitable personal device for example, a headset, wearable device (such as a watch or smart glasses), a tablet, laptop or mobile device.

The personal device 1006 comprises at least two microphones speaker, and electronic components for receiving speech input. The personal device may comprise a processing block 210, for example the processing block 210 as illustrated in FIG. 2. For the personal device, the processing block 210 may be configured to distinguish between the near-field speaker, in this example the individual 1002A, speaking as opposed to any other person in the proximity of the personal device 1006 speaking, in this example the individual 1002B. The signals representing speech by the individual 1002B may also be considered as interfering noise signals by the processing block 210 in the personal device 1006, as well as the other examples of interfering noise given above.

Without the proposed processing block 210, for example, as illustrated in FIG. 2, the personal device 1006 may have incorrectly processed voice commands from the individual 1002A because of the interference sources. Speech from the individual 1002A may not have been recognizable by the personal device 1006 because the amplitude of interference drowns out the individual 1002A's speech.

However, by utilising the processing block 210 to process the received signals from the at least two microphones, the personal device 1006 is able to process the received signals to determine voice commands and to remove the interfering noise signals.

Furthermore, it may be preferable for the design of the personal device 1006 to be physically small in terms of size, which may therefore require the at least two microphones to be closely spaced. The implementation of the proposed embodiments in such a personal device 1006 may therefore be used to overcome the issues regarding the noise interference, as well as the small size of the personal device requiring the microphones to be closely spaced.

The schematic flow chart diagram of FIG. 3 is generally set forth as a logical flow chart diagram. As such, the depicted order and labeled steps are indicative of aspects of the disclosed method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagram, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

If implemented in firmware and/or software, functions described above may be stored as one or more instructions or code on a computer-readable medium. Examples include non-transitory computer-readable media encoded with a data structure and computer-readable media encoded with a computer program. Computer-readable media includes physical computer storage media. A storage medium may be any available medium that can be accessed by a computer. By way of example, and not limitation, such computer-readable media can comprise random access memory (RAM), read-only memory (ROM), electrically-erasable programmable read-only memory (EEPROM), compact disc read-only memory (CD-ROM) or other optical disk storage, magnetic disk storage or other magnetic storage devices, or any other medium that can be used to store desired program code in the form of instructions or data structures and that can be accessed by a computer. Disk and disc includes compact discs (CDs), laser discs, optical discs, digital versatile discs (DVDs), floppy disks and Blu-ray discs. Generally, disks reproduce data magnetically, and discs reproduce data optically. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

Although the present disclosure and certain representative advantages have been described in detail, it should be understood that various changes, substitutions and alterations can be made herein without departing from the spirit and scope of the disclosure as defined by the appended claims. For example, although the description above refers to processing and extracting a speech signal from microphones of a mobile device, the above-described methods and systems may be used for extracting other signals from other devices. Other systems that may implement the disclosed methods and systems include, for example, processing circuitry for audio equipment, which may need to extract an instrument sound from a noisy microphone signal. Yet another system may include a radar, sonar, or imaging system that may need to extract a desired signal from a noisy sensor. Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

The invention claimed is:

1. A method comprising:

receiving a first audio input signal and a second audio input signal;

estimating a noise correlation statistic between the first audio input signal and the second audio input signal;

estimating an inter sensor signal model representative of a relationship between desired signal components present in the first audio input signal and the second audio input signal;

wherein responsive to the noise correlation statistic meeting a predefined condition, the step of estimating an inter sensor signal model is based on the noise correlation statistic; and responsive to the noise correlation statistic not meeting the predefined condition, the step of estimating an inter sensor signal model is based on a constrained noise correlation statistic derived from the noise correlation statistic.

2. The method of claim 1 wherein the noise correlation statistic comprises a normalized noise cross correlation, between the first audio input signal and the second audio input signal.

3. The method of claim 1 wherein the predefined condition comprises a maximum threshold for the energy of the normalized noise cross correlation.

4. The method of claim 3 wherein the predefined condition comprises that a norm of the normalized noise cross correlation does not exceed a first threshold.

5. The method of claim 4 wherein the predefined condition further comprises that the norm of the normalized noise cross correlation does not exceed a second threshold.

6. The method of claim 1 wherein the constrained noise correlation statistic is derived from the noise correlation statistic by rescaling the noise correlation statistic by a norm of the noise correlation statistic.

7. The method of claim 1 further comprising:

updating at least one coefficient of the inter sensor signal model every two samples of the received first audio input signal and second audio input signal.

8. The method of claim 1 further comprising:

applying the inter sensor signal model to one of the first audio input signal and the second audio input signal to generate a modelled signal;

comparing the modelled signal to another of the first audio input signal and the second audio input signal to generate a noise signal; and using the noise signal or a signal derived therefrom to perform adaptive noise cancellation on a beamformed signal derived from at least the first audio input signal and the second audio input signal.

9. The method of claim 8 wherein the step of estimating the inter sensor signal model is further based on the noise signal.

10. The method of claim 1 further comprising:

receiving a third audio input signal;

estimating a second noise correlation statistic between the third audio input signal and the second audio input signal;

estimating a second inter sensor signal model representative of a relationship between desired signal components present in the third audio input signal and the second audio input signal;

wherein responsive to the second noise correlation statistic meeting a predefined condition, the step of estimating the second inter sensor signal model is based on the second noise correlation statistic; and responsive to the second noise correlation statistic not meeting the predefined condition, the step of estimating the second inter sensor signal model is based on a second constrained noise correlation statistic derived from the second noise correlation statistic.

11. The method of claim 1 wherein one or more coefficients of the inter sensor signal model are updated online.

12. The method of claim 7, wherein the step of updating is performed in a digital signal processor using a dual multiply and accumulator (MAC) computational block.

13. The method of claim 12 wherein the step of updating comprises performing two MAC operations in a single instruction cycle.

14. The method of claim 1 wherein the noise correlation statistic is estimated from the first audio input signal and the second audio input signal when there are no desired signal components in the first audio input signal and the second audio input signal.

15. The method of claim 14 further comprising determining that there are no desired signal components by:

detecting whether the first audio input signal or the second audio input signal comprises signal components indicative of voice using a voice activity detector.

16. The method of claim 1 wherein the step of estimating the inter sensor signal model is performed using a least squares cost function.

17. The method of claim 1 wherein the step of estimating the inter sensor signal model is performed using a total least squares cost function.

18. A processor, comprising:

a first input configured to receive a first audio input signal and a second input configured to receive a second audio input signal;

a noise correlation determination block configured to estimate a noise correlation statistic between the first audio input signal and the second audio input signal;

an inter sensor signal model estimator configured to estimate an inter sensor signal model representative of a relationship between desired signal components present in the first audio input signal and the second audio input signal;

wherein responsive to the noise correlation statistic meeting a predefined condition, the inter sensor signal model estimator is configured to estimate the inter sensor signal model based on the noise correlation statistic; and responsive to the noise correlation statistic not meeting the predefined condition, the inter sensor signal model estimator is configured to estimate the inter sensor signal model based on a constrained noise correlation statistic derived from the noise correlation statistic.

19. The processor of claim 18 wherein the noise correlation statistic comprises a normalized noise cross correlation between the first audio input signal and the second audio input signal.

20. The processor of claim 19 wherein the predefined condition comprises a maximum threshold for the energy of the normalized noise cross correlation.

21. The processor of claim 20 wherein the predefined condition comprises that a norm of the normalized noise cross correlation does not exceed a first threshold.

22. The processor of claim 21 wherein the predefined condition further comprises that the norm of the normalized noise cross correlation does not exceed a second threshold.

23. The processor of claim 18 wherein the constrained noise correlation statistic is derived from the noise correlation statistic by rescaling the noise correlation statistic by a norm of the noise correlation statistic.

24. The processor of claim 18 wherein the inter sensor signal model estimator is configured to update at least one coefficient of the inter sensor signal model every two samples of the received first audio input signal and second audio input signal.

25. The processor of claim 18 further configured to:

apply the inter sensor signal model to one of the first audio input signal and the second audio input signal to generate a modelled signal;

compare the modelled signal to another of the first audio input signal and the second audio input signal to generate a noise signal; and use the noise signal or a signal derived therefrom to perform adaptive noise cancellation on a beamformed signal derived from at least the first audio input signal and the second audio input signal.

26. The processor of claim 25 wherein the step of estimating the inter sensor signal model is further based on the noise signal.

27. The processor of claim 18 wherein one or more coefficients of the inter sensor signal model are updated online.

28. The processor of claim 24, wherein the inter sensor signal model estimator is configured to update the at least one coefficient in a digital signal processor using a dual multiply and accumulator (MAC) computational block.

29. The processor of claim 28 wherein the inter sensor signal model estimator is configured to update the at least one coefficient by performing two MAC operations in a single instruction cycle.

30. The processor of claim 18 wherein the noise correlation statistic is estimated from the first audio input signal and the second audio input signal when there are no desired signal components in the first audio input signal and the second audio input signal.

31. The processor of claim 18 further configured to:

determine that there are no desired signal components by detecting whether the first audio input signal or the second audio input signal comprises signal components indicative of voice using a voice activity detector.

32. The processor of claim 18 wherein the inter sensor signal model estimator is configured to estimate the inter sensor signal model by using a least squares cost function.

33. The processor of claim 18 wherein the inter sensor signal model estimator is configured to estimate the inter sensor signal model by using a total least squares cost function.

34. The processor of claim 18, wherein the inter sensor signal model generates a modelled signal that is used for signal processing.

35. The method of claim 1, wherein the inter sensor signal model generates a modelled signal that is used for signal processing.

* * * * *